US006648088B2

(12) United States Patent
Gabioli

(10) Patent No.: US 6,648,088 B2
(45) Date of Patent: Nov. 18, 2003

(54) RADIATOR FOR EARTH MOVING MACHINES

(75) Inventor: Fabio Gabioli, Cerea (IT)

(73) Assignee: Komatsu Utility Europe S.P.A., Vicenza (IT)

( * ) Notice: Subject to any disclaimer, the term of this patent is extended or adjusted under 35 U.S.C. 154(b) by 0 days.

(21) Appl. No.: 09/886,048

(22) Filed: Jun. 22, 2001

(65) Prior Publication Data

US 2002/0139594 A1 Oct. 3, 2002

(30) Foreign Application Priority Data

Mar. 29, 2001 (EP) ..... 01830216

(51) Int. Cl.[7] ..... B60K 11/04

(52) U.S. Cl. ..... 180/68.4; 180/68.6; 165/86; 123/41.43

(58) Field of Search ..... 180/68.1, 68.4, 180/68.6, 291, 294, 298; 165/86, 41; 248/213.3, 232, 233; 123/41.43, 41.48, 41.49

(56) References Cited

U.S. PATENT DOCUMENTS 2,965,187 A * 12/1960 Zeman ..... 172/831
3,834,478 A * 9/1974 Alexander et al. ..... 165/77
3,938,586 A * 2/1976 Barlow et al. ..... 165/51
4,287,961 A * 9/1981 Steiger ..... 123/41.43
4,420,058 A * 12/1983 Sato et al. ..... 180/68.6
4,696,361 A * 9/1987 Clark et al. ..... 123/41.43
4,825,815 A * 5/1989 Turner ..... 123/41.49
5,492,167 A * 2/1996 Glesmann ..... 123/563
6,092,616 A * 7/2000 Burris et al. ..... 180/68.1
6,257,359 B1 * 7/2001 Granlund et al. ..... 165/51

* cited by examiner

*Primary Examiner*—Brian L. Johnson
*Assistant Examiner*—Kelly E Campbell
(74) *Attorney, Agent, or Firm*—Browdy and Neimark, P.L.L.C.

(57) ABSTRACT

A radiator for earth moving machines connected to the engine of the earth moving machine and comprising first connecting means that pivotally fasten the radiator to the frame, in such a way that the radiator can rotate about its own lower edge from a closed position in which it is approached to the frame to an open position in which it is in part moved away from the frame. The first connecting means comprise a plurality of support elements each integrally fastened to the frame in correspondence with the lower edge of the radiator. Each support element has a saddle shaped portion oriented upwards, into which is inserted the lower edge of the radiator.

16 Claims, 3 Drawing Sheets

RADIATOR FOR EARTH MOVING MACHINES

BACKGROUND OF THE INVENTION

1. Technical Field of the Invention

The present invention relates to a radiator for earth moving machines.

2. Prior Art

Although the present invention is applicable to all earth moving machines, it is advantageously applicable to earth moving machines of relatively small dimensions, in particular those known as Skid Steer Loaders.

Hereafter, therefore, explicit reference shall be made to Skid Steer Loaders, although the considerations set out herein are equally valid for any other earth moving machine.

In Skid Steer Loaders, the engine is mounted in the rear area of the machine and the engine water cooling radiator is fastened, in substantially vertical position, to the rear part of the frame by means of a plurality of screws.

In some embodiments the radiator is then protected by an openable protective hood.

To increase the flow of air that hits the radiator, machines are also provided with a cooling fan positioned to the interior of the machine relative to the radiator.

The prior art described above, however, has a series of drawbacks.

When using the machine, the radiator and the fan are subject to being frequently fouled with dirt residues, dust and the like, thereby having their efficiency reduced at least in part.

In such circumstances it is thus necessary to intervene manually to clean them.

One then has to unscrew the screws the fasten the radiator, disconnect the hydraulic connections between the engine and the radiator, in order to remove the radiator itself.

One thereby has access both to the fan and to the interior part of the radiator.

However such an operation takes a long time and forces to keep the machine idle for an extended period.

In particular, servicing times are linked to the need to disconnect the hydraulic connections between the engine and the radiator, and subsequently to return the entire system to its previous condition.

A similar problem occurs when it is necessary to work on the radiator itself or other interior parts of the machine located behind the radiator, in order to perform other maintenance operations.

SUMMARY OF THE INVENTION

In this situation the technical task constituting the basis for the present invention is to obtain a radiator for earth moving machines that overcomes the aforementioned drawbacks.

In particular, the technical task of the present invention is to provide a radiator for earth moving machine that allows to conduct, easily and rapidly, cleaning operations on the radiator and fan, and that at the same time allows an easy access to all other parts of the machine mounted behind the radiator.

BRIEF DESCRIPTION OF THE DRAWINGS

Further features and advantages of the present invention shall become more readily apparent from the detailed description of a preferred, but not exclusive, embodiment of a radiator for earth moving machines, illustrated in the accompanying drawings, in which.

DESCRIPTION OF THE PREFERRED EMBODIMENT

Figure 1:
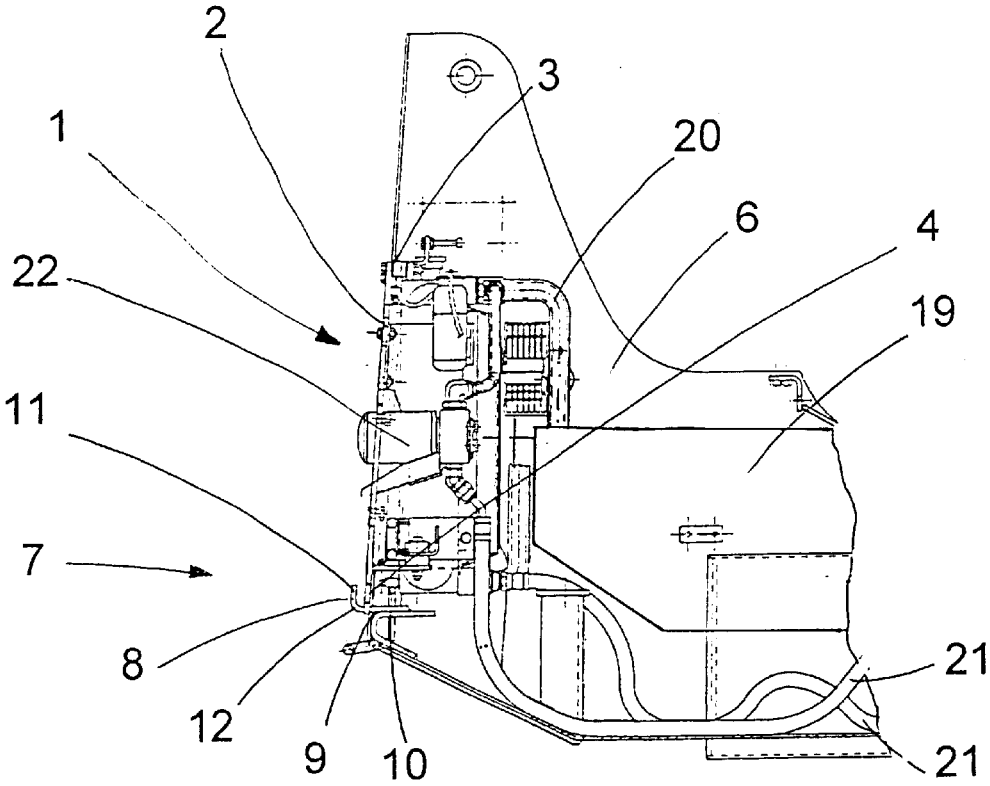
FIG. 1 shows a lateral view of a radiator according to the present invention, mounted on an earth moving machine, with some parts removed the better to highlight others.

With reference to the aforementioned drawings, the reference number 1 globally indicates a radiator for earth moving machines.

The radiator 1 illustrated in the accompanying figures comprises an outer support plate 2 and has an upper edge 3, a lower edge 4, and two lateral edges 5. The edges 3, 4, 5, in the illustrated embodiment, coincide with the edges of the plate.

The radiator 1 is also able to be pivotally fastened to a frame 6 of an earth moving machine with first connecting means 7, in such a way as to be able to rotate about its own lower edge 4 from a closed position in which the radiator 1 lies in a substantially vertical plane relative to the ground and is approached to the frame 6, to an open position in which it lies in an inclined plane relative to the ground and it is moved partly away from the frame 7.

In a first embodiment the first connecting means 7 comprise at least a support element 8 integrally fastened to the frame 6 in correspondence with the lower edge 4 of the radiator 1.

Said support element 8 has a planar, substantially horizontal lower area 9 fastened, in correspondence with a first edge 10, to the frame 6 of the machine, and a sealing area 1 developing from a second edge 12 of the lower area 9, substantially perpendicular to the lower area 9 itself and parallel to the frame 6.

Said lower area 9 and sealing area 11 define a saddle shaped area 12 oriented upwards into which is inserted and onto which bears the lower edge 4 of the radiator 1.

In the embodiment illustrated in the accompanying figures, the first connecting means 7 comprise a plurality of support elements, each integrally fastened to the frame 6 in correspondence with the lower edge 4 of the radiator 1.

Each support element 8 has a saddle shaped portion 12 oriented upwards into which is inserted and onto which bears the lower edge 4 of the radiator 1.

Moreover, on the lower edge 4 of the radiator are obtained a plurality of housings 13 each in correspondence with a support element 8.

Figure 6:
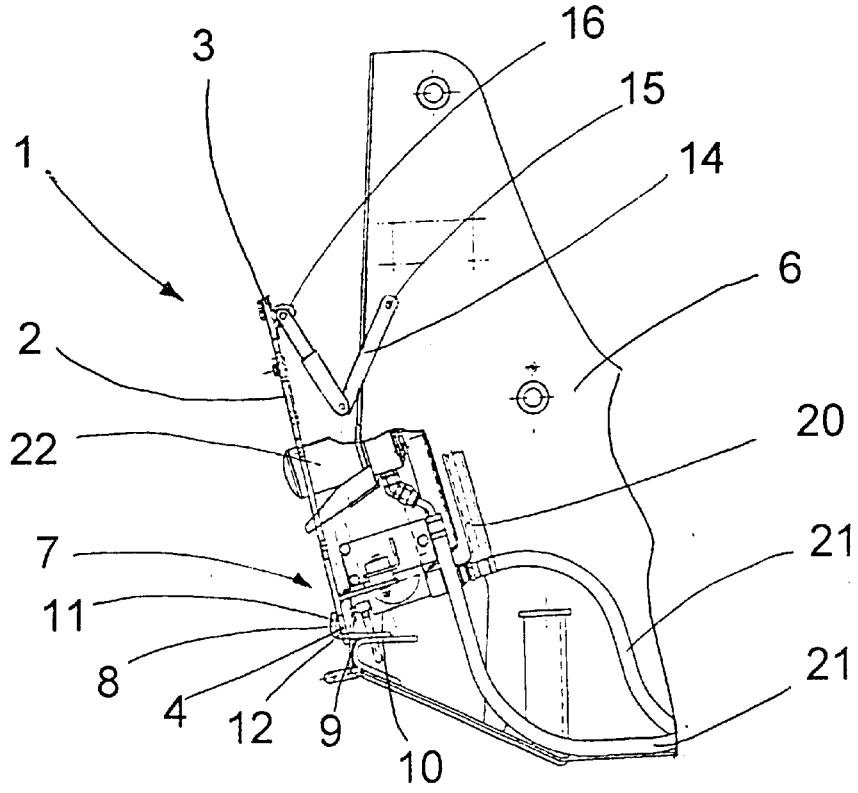
FIG. 6 shows a lateral view of a radiator in the open position according to a second embodiment of the present invention with some parts removed the better to highlight others.
Figure 4:
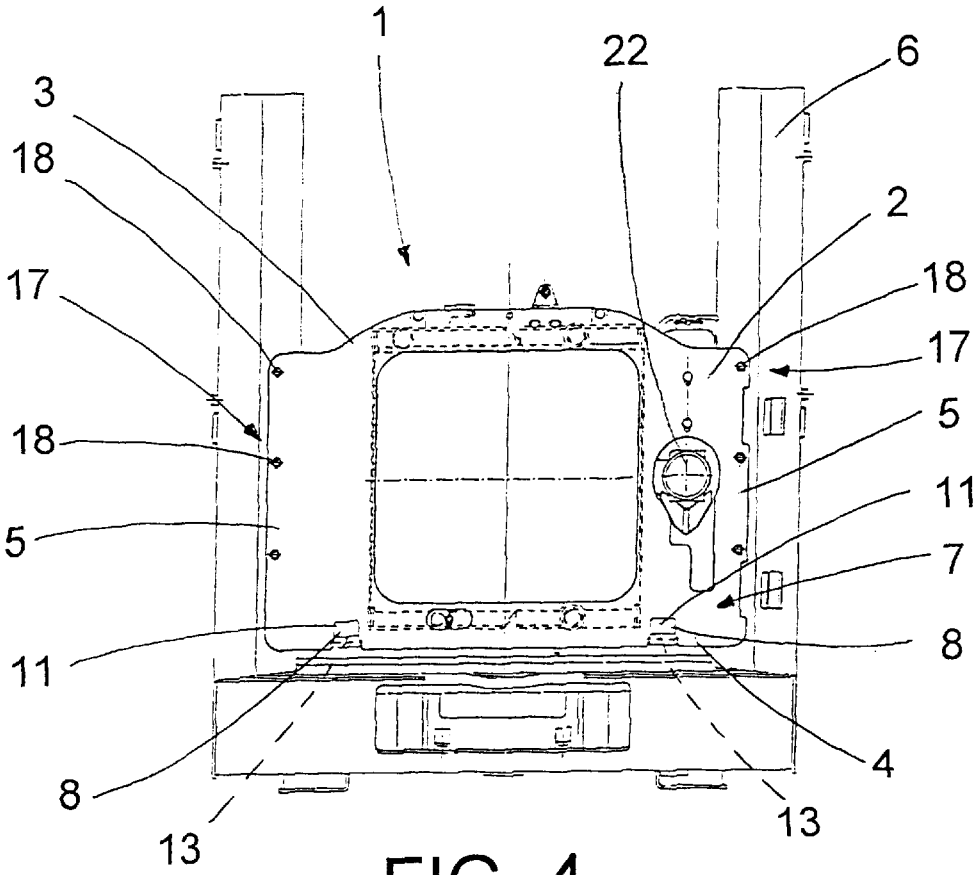
FIG. 4 shows a rear view of the radiator of FIG. 1.
Figure 5:
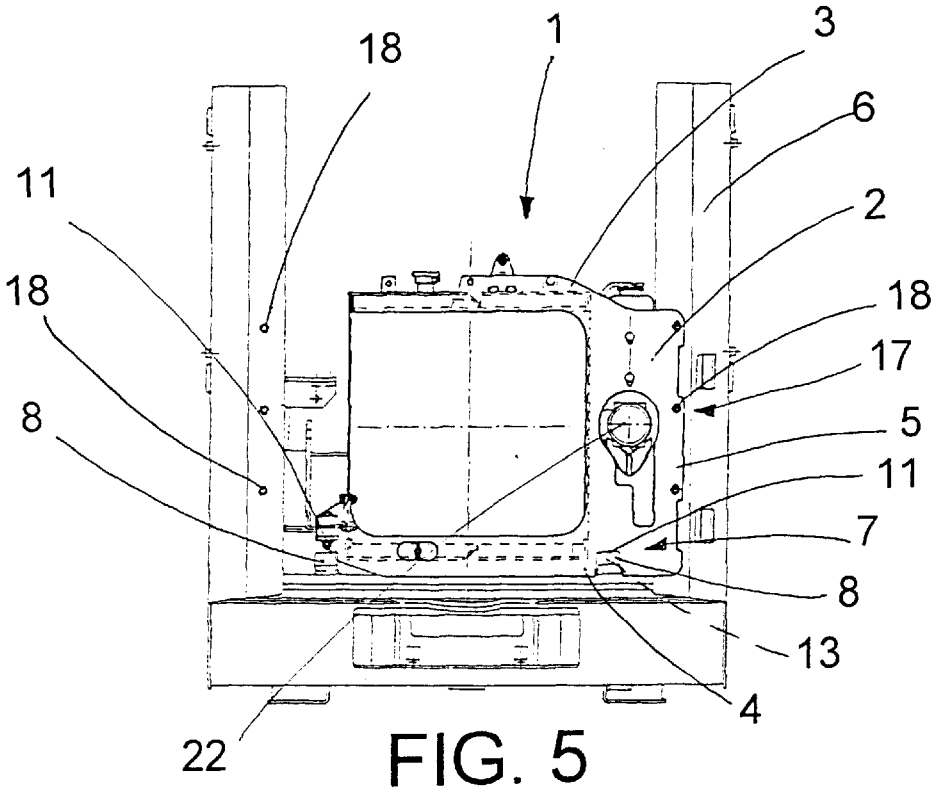
FIG. 5 shows the radiator of FIG. 4 with some parts removed the better to highlight others.

In a second embodiment, the first connecting means 7 comprise at least an extensible return arm 14 (FIG. 6).

Said return arm 14 has a first end 15 fastened to the frame 6 and a second end 16 fastened to the radiator 1.

Said arm 14 can be used together with support elements 8 (as shown in FIG. 6) or alone, depending on requirements.

In other embodiments, the support elements 8 can be replaced with one or more hinges, although this solution is less advantageous because it increases the number of fixed connections between the radiator 1 and the frame 6.

All embodiments can also be provided with second means 17 for connecting the radiator 1 to the frame 6 in order to fasten the radiator 1 to the frame 6 in removable fashion when the radiator 1 itself is in the closed position.

In known arrangements, said second connecting means 17 are advantageously constituted by a plurality of screws 18 that connect the lateral edges 5 of the radiator 1 to the frame 6.

Figure 3:
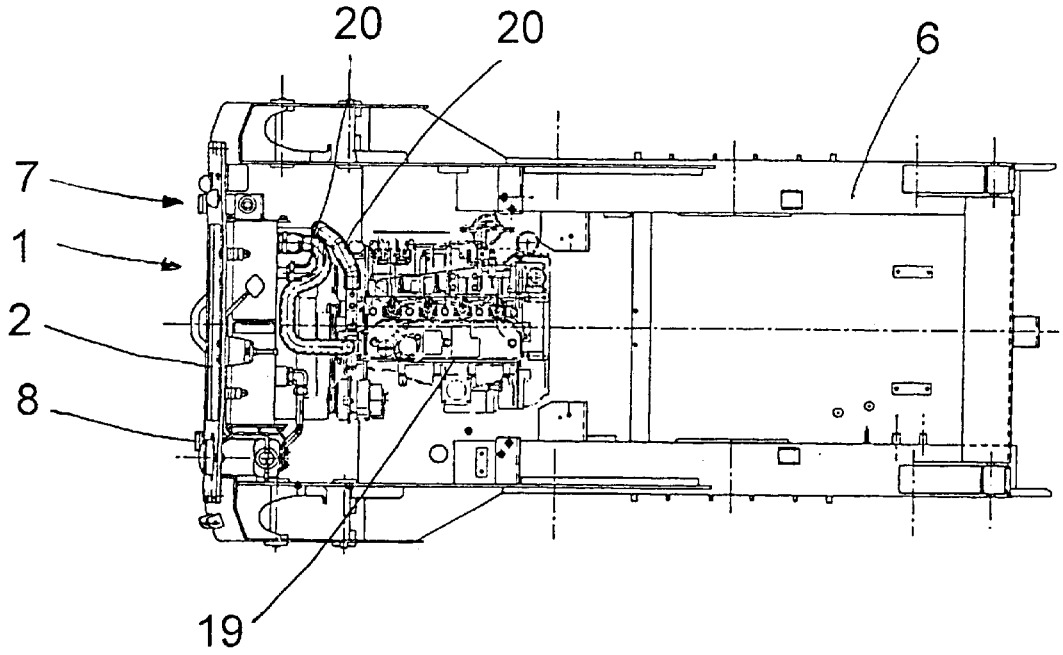
FIG. 3 shows a plan view of a detail of the radiator of FIG. 1.

The radiator 1 is operatively connected to an engine 19 of the earth moving machine by means of at least two flexible hydraulic conduits 20 for cooling the water of the engine 19 (FIG. 3).

Figure 2:
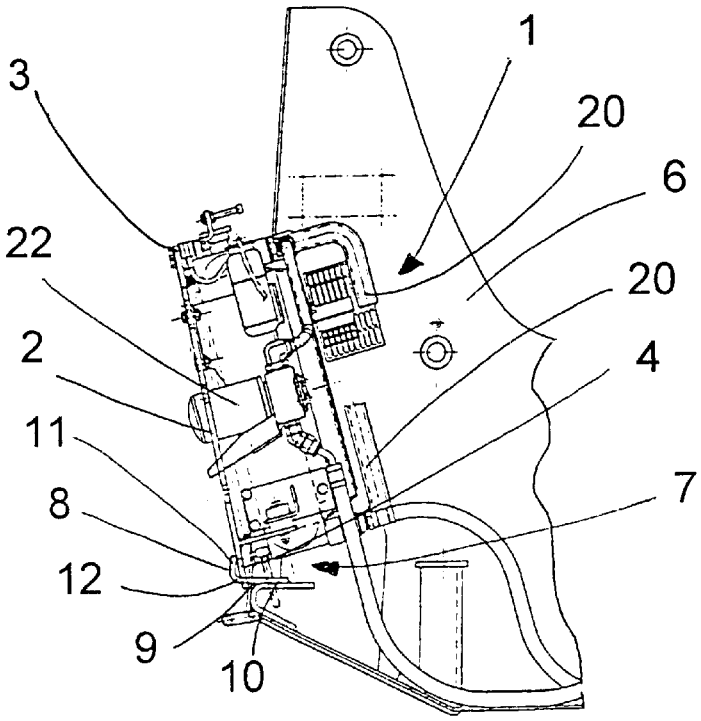
FIG. 2 shows the radiator of FIG. 1 in the open position, with some parts removed the better to highlight others.

One of said conduits 20 can be connected to the upper part of the radiator 1 and the other to its lower part, as shown in FIGS. 1, 2 and 6.

Preferably, at least the upper conduit 20 is made of a semi-rigid material and is so shaped as to be flexible because of its structural conformation.

In the illustrated embodiment, for instance, the upper hydraulic conduit 20 is shaped, at least in part, as an "S".

Moreover, the illustrated embodiments show a radiator 1 for cooling both water and oil, which comprises two additional hydraulic conduits 21 for the oil and a filter 22, according to well known arrangements.

From the functional point of view, when it is necessary to work on an earth moving machine mounting the radiator 1 of the present invention, to conduct maintenance operations on the radiator 1, on the fan or on parts of the machine positioned behind the radiator 1, the second connecting means 17 are removed to allow opening the radiator 1.

Said radiator 1 is made to rotate from the closed position to the open position by means of a rotation, substantially about its own lower edge 4, towards the exterior of the earth moving machine.

The travel of this rotation is determined by the end stop of the return arm 14 or by the hinges, or, when these elements are not present, by the dimensioning of the support elements 8, and in particular of the sealing area 11.

In the open position the lower edge 4 of the radiator 1 bears in part against the frame 6 and in part against the sealing area 11 of the support element 8, and hence its position is a direct consequence of the geometric dimensions of the support element 8.

Thanks to the flexibility of the hydraulic conduits 20, said conduits can easily follow the radiator 1 during its actuation, allowing the radiator to be opened without requiring the disassembly of the hydraulic system.

The present invention achieve important advantages.

Thanks to the present invention, cleaning the interior part of the radiator and of the fan and accessing the parts of the machine located behind the radiator is considerably simplified.

Once the fastening screws are removed, the radiator can be opened whilst still remaining attached to the machine, thereby avoiding the need to disconnect the hydraulic system.

Moreover, when it becomes necessary to detach the radiator to perform more complex maintenance operations, all that is required is to detach the hydraulic conduits and extract the radiator from the support elements.

It should also be noted that the present invention is relatively easy to construct and that also the cost connected to embodying the invention is not very high.

The invention thus conceived can be subject to numerous modifications and variations, without thereby departing from the scope of the inventive concept that characterizes it.

All components can be replaced by technically equivalent elements and in practice all materials employed, as well as the shapes and the dimensions of the various components, can be any according to needs.

What is claimed:

1. An earth moving machine comprising:

a frame;

an engine;

a radiator operatively connected to said engine and having a lower edge;

first means for pivotally engaging the radiator on the frame, wherein said first means comprises at least a support element integrally fastened to the frame in correspondence to said lower edge of the radiator, and has a saddle shaped portion oriented upwards, said lower edge of the radiator being rotatably supported on said saddle shaped portion;

said radiator being able to rotate about said lower edge on the saddle portion, from a closed position in which said radiator is located within the frame to an open position in which said radiator is in part rotated out from within the frame until a front of the radiator engages the saddle shaped portion; and second means for connecting said radiator to the frame in order to fasten said radiator in removable fashion to the frame in said closed position.

2. A machine as claimed in claim 1 wherein said saddle shaped portion comprises a planar substantially horizontal lower area having a first edge fastened to the frame of the machine, and a second edge, and a sealing area developing from the second edge of the lower area, substantially perpendicular to the lower area itself and parallel to the frame, wherein the front of the radiator engages the sealing area in the open position.

3. A machine as claimed in claim 2 wherein said lower edge of the radiator has a at least a housing in correspondence with the support element.

4. A machine as claimed in claim 3 wherein said radiator comprises an outer support plate defining said lower edge.

5. A machine as claimed in claim 1 wherein said radiator comprises an outer support plate defining said lower edge.

6. A machine as claimed in claim 1 wherein said first connecting means comprise a plurality of support elements each integrally fastened to the frame in correspondence with said lower edge of the radiator, and each having a saddle shaped portion oriented upwards, said lower edge of the radiator being inserted in said saddle shaped portions of the support elements.

7. A machine as claimed in claim 6 wherein said saddle shaped portion comprises a planar substantially horizontal lower area having a first edge fastened to the frame of the machine, and a second edge, and a sealing area developing from the second edge of the lower area, substantially perpendicular to the lower area itself and parallel to the frame.

8. A machine as claimed in claim 7 wherein said lower edge of the radiator has at least a housing in correspondence with the support element.

9. A machine as claimed in claim 8 wherein said radiator comprises an outer support plate defining said lower edge.

10. A machine as claimed in claim 6 wherein said radiator comprises an outer support plate defining said lower edge.

11. A machine as claimed in claim 6 wherein said first connecting means further comprises at least an extensible return arm presenting a first end fastened to said frame and a second end fastened to said radiator, to support said radiator.

12. A machine as claimed in claim 6 further comprising at least a flexible hydraulic conduit connected between said engine and said radiator.

13. A machine as claimed in claim 12 wherein said hydraulic conduit is semi-rigid and is at least in part shaped as an "S".

14. A machine as claimed in claim 1 wherein said first connecting means further comprises at least an extensible return arm presenting a first end fastened to said frame and a second end fastened to said radiator, to support said radiator.

15. A machine as claimed in claim 1 further comprising at least a flexible hydraulic conduit connected between said engine and said radiator.

16. A machine as claimed in claim 15 wherein said hydraulic conduit is semi-rigid and is at least in part shaped as an "S".

* * * * *